US010393329B2

(12) United States Patent
Germain

(10) Patent No.: US 10,393,329 B2
(45) Date of Patent: Aug. 27, 2019

(54) LIGHT FIXTURE MECHANICAL INTERCONNECT WITH ROTATIVE JOINING

(71) Applicant: GE Lighting Solutions, LLC, East Cleveland, OH (US)

(72) Inventor: Steve Germain, Lachine (CA)

(73) Assignee: CURRENT LIGHTING SOLUTIONS, LLC, New Canaan, CT (US)

( * ) Notice: Subject to any disclaimer, the term of this patent is extended or adjusted under 35 U.S.C. 154(b) by 0 days.

(21) Appl. No.: 15/638,405

(22) Filed: Jun. 30, 2017

(65) Prior Publication Data

US 2018/0135817 A1 May 17, 2018

Related U.S. Application Data

(60) Provisional application No. 62/423,749, filed on Nov. 17, 2016.

(51) Int. Cl.

| | |
|---|---|
| ***F21S 8/04*** | (2006.01) |
| ***F21S 2/00*** | (2016.01) |
| ***F21S 4/28*** | (2016.01) |
| ***F21S 8/00*** | (2006.01) |
| ***F21S 8/06*** | (2006.01) |
| ***F21V 17/00*** | (2006.01) |
| ***F21V 21/005*** | (2006.01) |
| *F21V 15/015* | (2006.01) |

(52) U.S. Cl.

CPC ..... *F21S 2/005* (2013.01); *F21S 2/00* (2013.01); *F21S 4/28* (2016.01); *F21S 8/036* (2013.01); *F21S 8/04* (2013.01); *F21S 8/061* (2013.01); *F21V 17/002* (2013.01); *F21V 21/005* (2013.01); *F21V 15/015* (2013.01); *F21V 17/00* (2013.01)

(58) Field of Classification Search

CPC .... F21S 2/005; F21S 8/036; F21S 4/28; F21S 8/04; F21S 8/061; F21S 4/00; F21S 4/20; F21S 8/043; F21S 8/046; F21S 8/06; F21S 8/063; F21V 17/002; F21V 15/015; F21V 17/00; F21V 17/18; F21V 15/012

See application file for complete search history.

(56) References Cited

U.S. PATENT DOCUMENTS

| | | | | |
|---|---|---|---|---|
| 4,726,781 | A * | 2/1988 | Bernhart | F21V 21/005 362/219 |
| 6,530,674 | B2 | 3/2003 | Grierson et al. | |
| 7,380,957 | B2 | 6/2008 | Lanczy | |
| 7,614,764 | B2 | 11/2009 | Williams et al. | |
| 2006/0050505 | A1 | 3/2006 | McCarthy et al. | |

(Continued)

OTHER PUBLICATIONS

Philippe et al., entitled "Connector Assembly for Mounting Lighting Fixture", GE co-pending U.S. Appl. No. 62/152,758, filed Apr. 24, 2015.

*Primary Examiner* — Y M. Lee

(74) *Attorney, Agent, or Firm* — Current Lighting Solutions LLC

(57) ABSTRACT

There is provided a light fixture that includes a mechanism for attaching the light fixture to another light fixture. The mechanism includes a set of retractable hooks configured to mate with an end of the other light fixture to attach the light fixture to the other light fixture.

20 Claims, 12 Drawing Sheets

(56) References Cited

U.S. PATENT DOCUMENTS

| | | | | |
|---|---|---|---|---|
| 2012/0075871 | A1* | 3/2012 | Chen | F21V 23/06 362/362 |
| 2014/0125232 | A1* | 5/2014 | Griffiths | F21V 21/005 315/154 |
| 2014/0268720 | A1 | 9/2014 | Dungan et al. | |
| 2015/0167902 | A1 | 6/2015 | Rodgers et al. | |
| 2017/0051905 | A1 | 2/2017 | Luu et al. | |

* cited by examiner

LIGHT FIXTURE MECHANICAL INTERCONNECT WITH ROTATIVE JOINING

I. CROSS-REFERENCE TO RELATED APPLICATIONS

The present disclosure claims the benefit of U.S. Provisional Patent Application No. 62/423,749, filed on Nov. 17, 2016, the content of which is incorporated herein in its entirety by reference.

II. TECHNICAL FIELD

The present disclosure relates to light fixtures. More particularly, the present disclosure relates to light fixtures including mechanical interconnects comprising rotative joining and hidden features.

III. BACKGROUND

Linear light fixtures are often attached together in a continuous row. The industry standard when attaching linear light fixtures requires the fixtures to be aligned. As such, during attachment, two technicians, one at each end of the light fixtures, must make sure that a proper alignment has been achieved. As such, because at least two technicians are needed, installing light fixtures in a continuous row can be costly.

Furthermore, the industry standard requires that the two fixtures be mechanically secured. This is normally done by using two or more screws that are mounted parallel to the fixtures, i.e. horizontally. This mounting arrangements leaves limited access for a drill or a screwdriver. Therefore, these constraints make it difficult for the installers to attach light fixtures in a continuous row.

Moreover, in typical continuous rows of light fixtures, the interface between the ends of two connected light fixtures are typically visible, which is unpleasing to the eye. To circumvent this issue, technicians may need to install covers on the joints between the light fixtures, which increases the cost and complexity of the installation.

IV. SUMMARY

The embodiments featured herein help solve or mitigate the above noted issues as well as other issues known in the art. For example, the embodiments provide a mechanism that allows mechanically connecting light fixtures in a continuous row with minimal technician involvement and without yielding visible features when the installation is complete. As such, the embodiments provide easy installation of a continuous row of fixtures, which requires at most one technician for installation. Further, the embodiments provide easy access to the joint between the light fixtures, thereby allowing a drill or screwdriver to operate and secure the fixtures.

One exemplary embodiment provides a light fixture that includes a mechanism for attaching the light fixture to another light fixture. The mechanism includes a set of retractable hooks configured to mate with an end of the other light fixture to attach the light fixture to the other light fixture.

Another exemplary embodiment provides a light fixture assembly that includes set of light fixtures comprising a first light fixture and a second light fixture connected via a mechanism hidden from view. The mechanism includes a set of hooks configured to mate with an end of one of the first and second light fixtures. The method includes attaching a first light fixture to a ceiling at both ends of the first light fixture via a set of suspension cable. The method includes mounting a second light fixture at a first end of the second light to a first end of the first light fixture; when mounted, the second light fixture is disposed in a vertical position with respect to the first light fixture. Furthermore, the method includes rotating the second light fixture to position the second light fixture in a horizontal position with respect to the first light fixture.

Additional features, modes of operations, advantages, and other aspects of various embodiments are described below with reference to the accompanying drawings. It is noted that the present disclosure is not limited to the specific embodiments described herein. These embodiments are presented for illustrative purposes only. Additional embodiments, or modifications of the embodiments disclosed, will be readily apparent to persons skilled in the relevant art(s) based on the teachings provided.

V. BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

Figure 5:
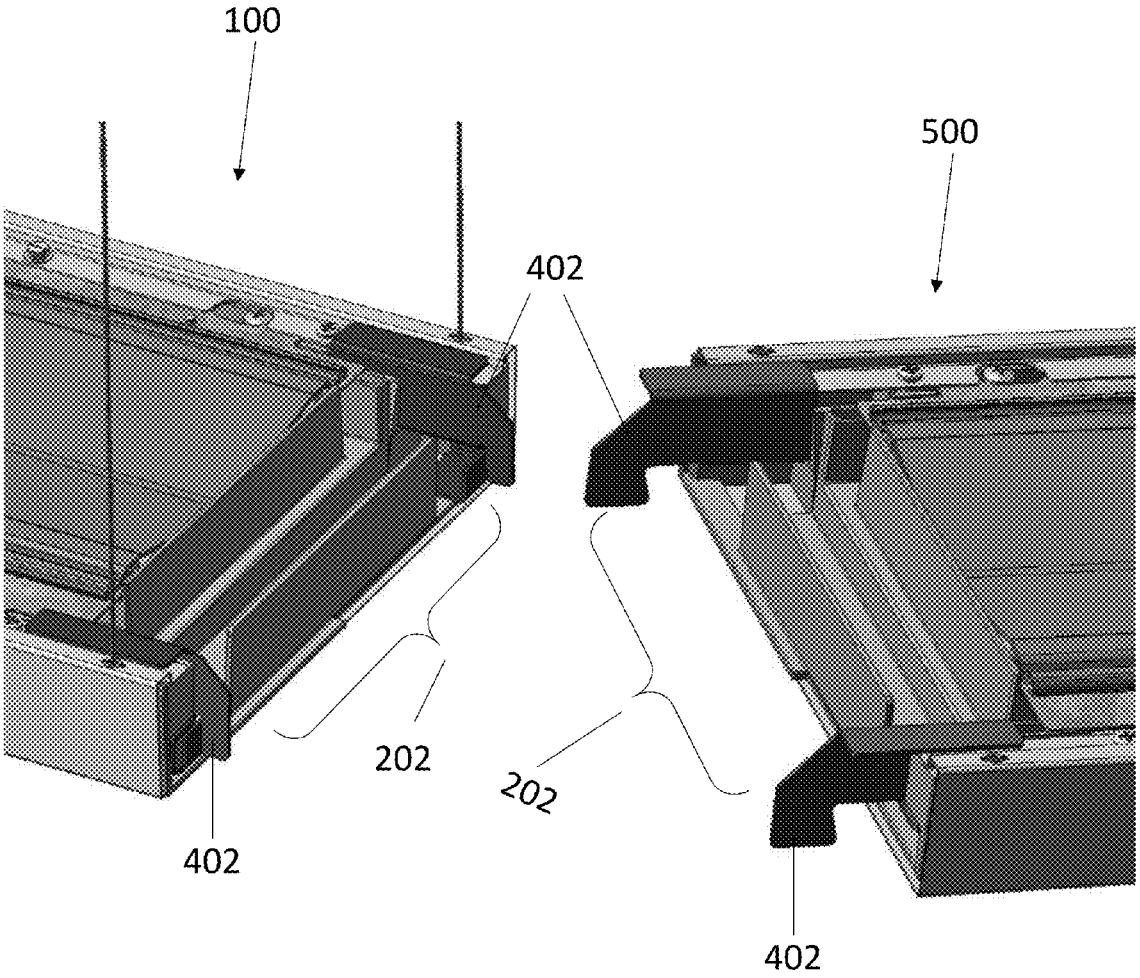

FIG. 5 an assembly of two linear light fixtures in accordance with various aspects described herein.

Figure 6:
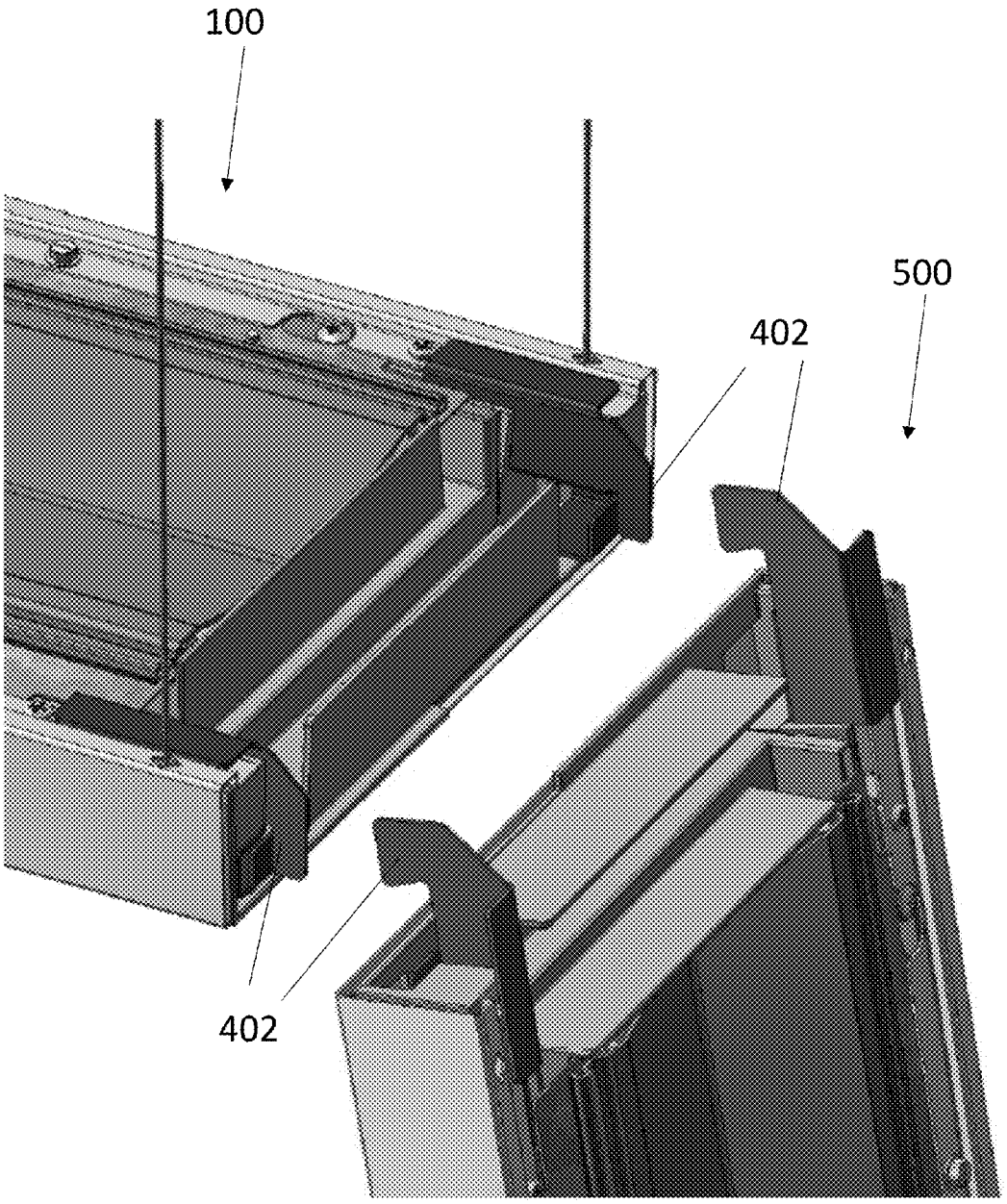

FIG. 6 illustrates another view of an assembly of two linear light fixtures in accordance with various aspects described herein.

Figure 7:
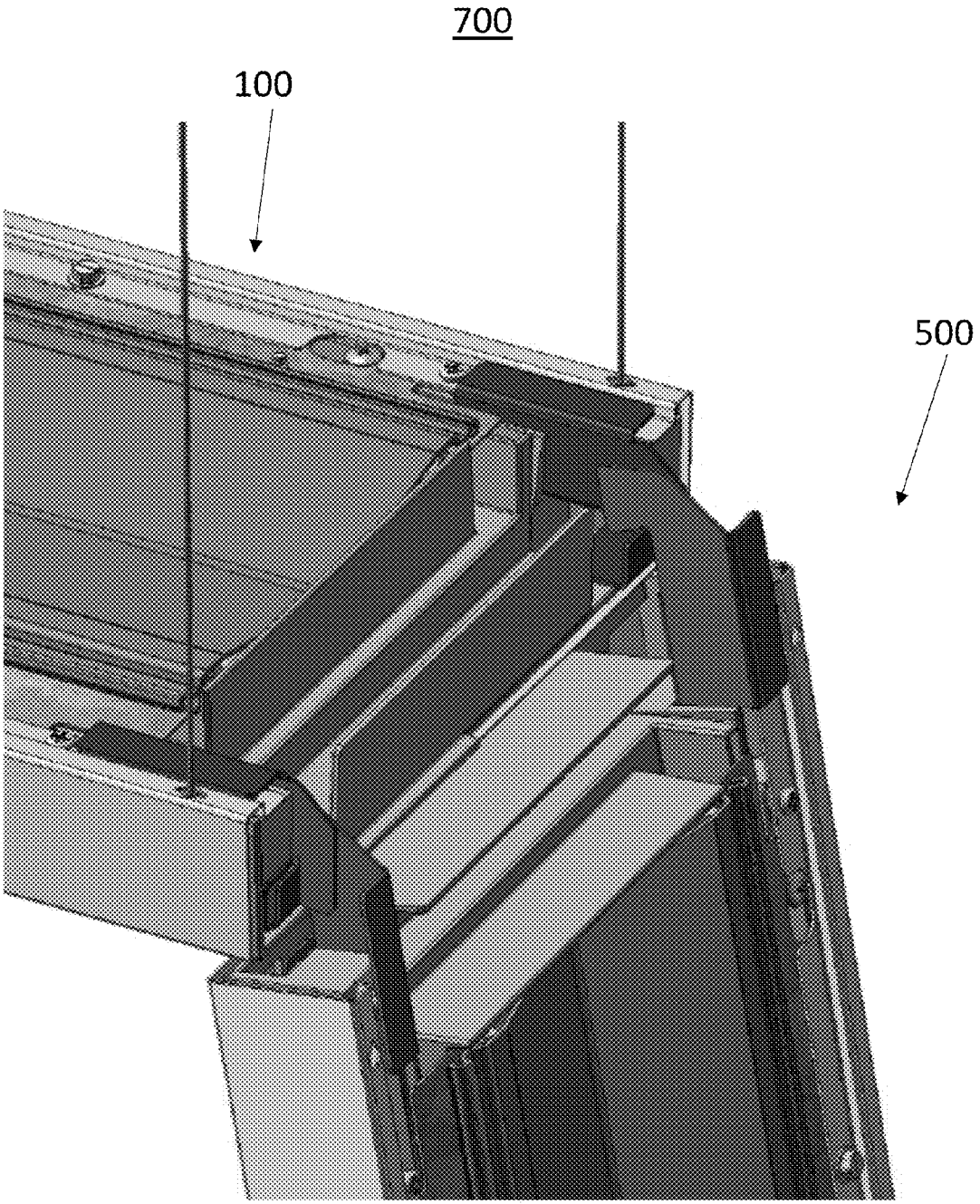

FIG. 7 illustrates yet another view of an assembly of two linear light fixtures in accordance with various aspects described herein.

Figure 8:
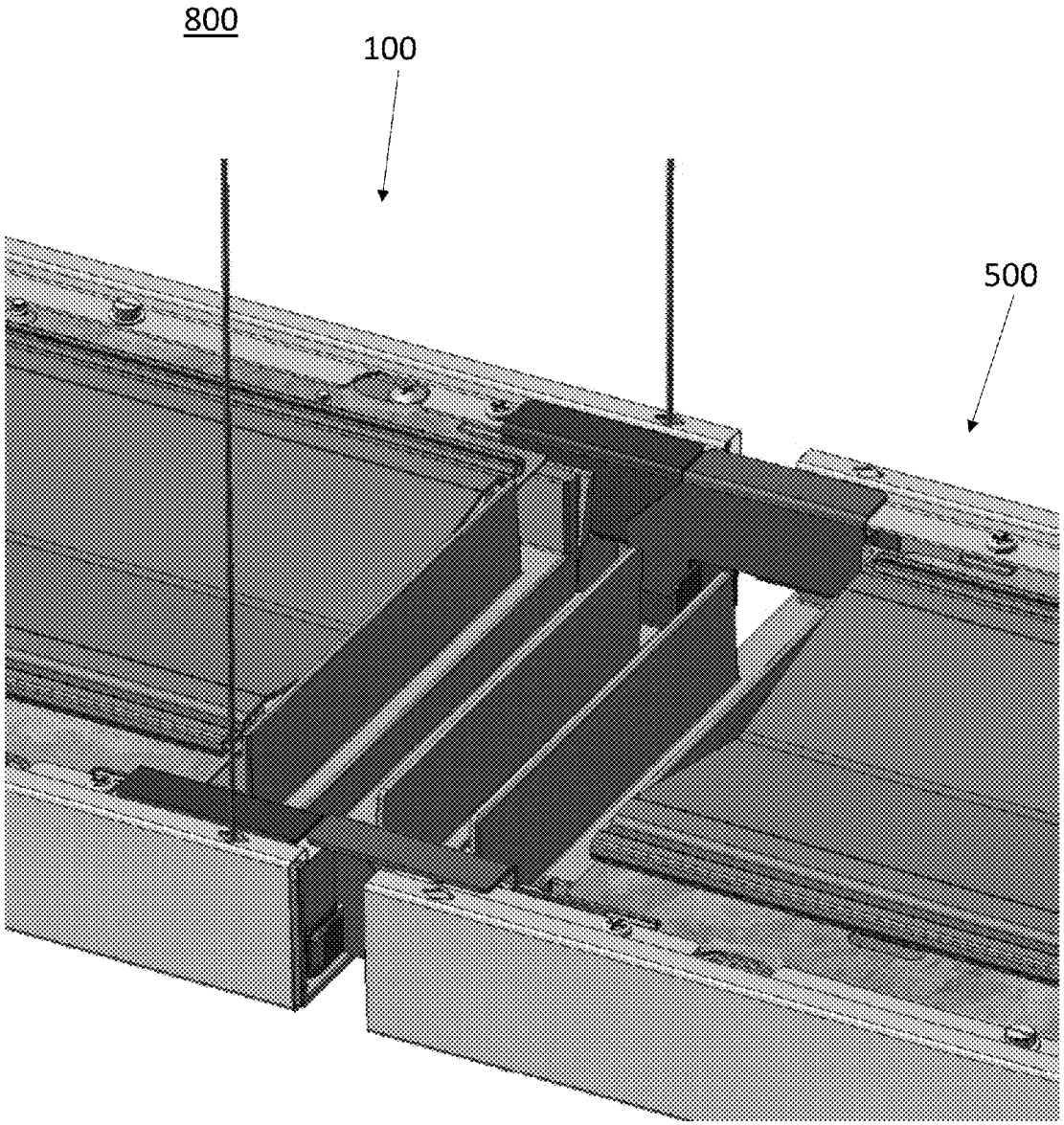

FIG. 8 illustrates a view of a fully assembled set of linear light fixtures in accordance with various aspects described herein.

Figure 9:
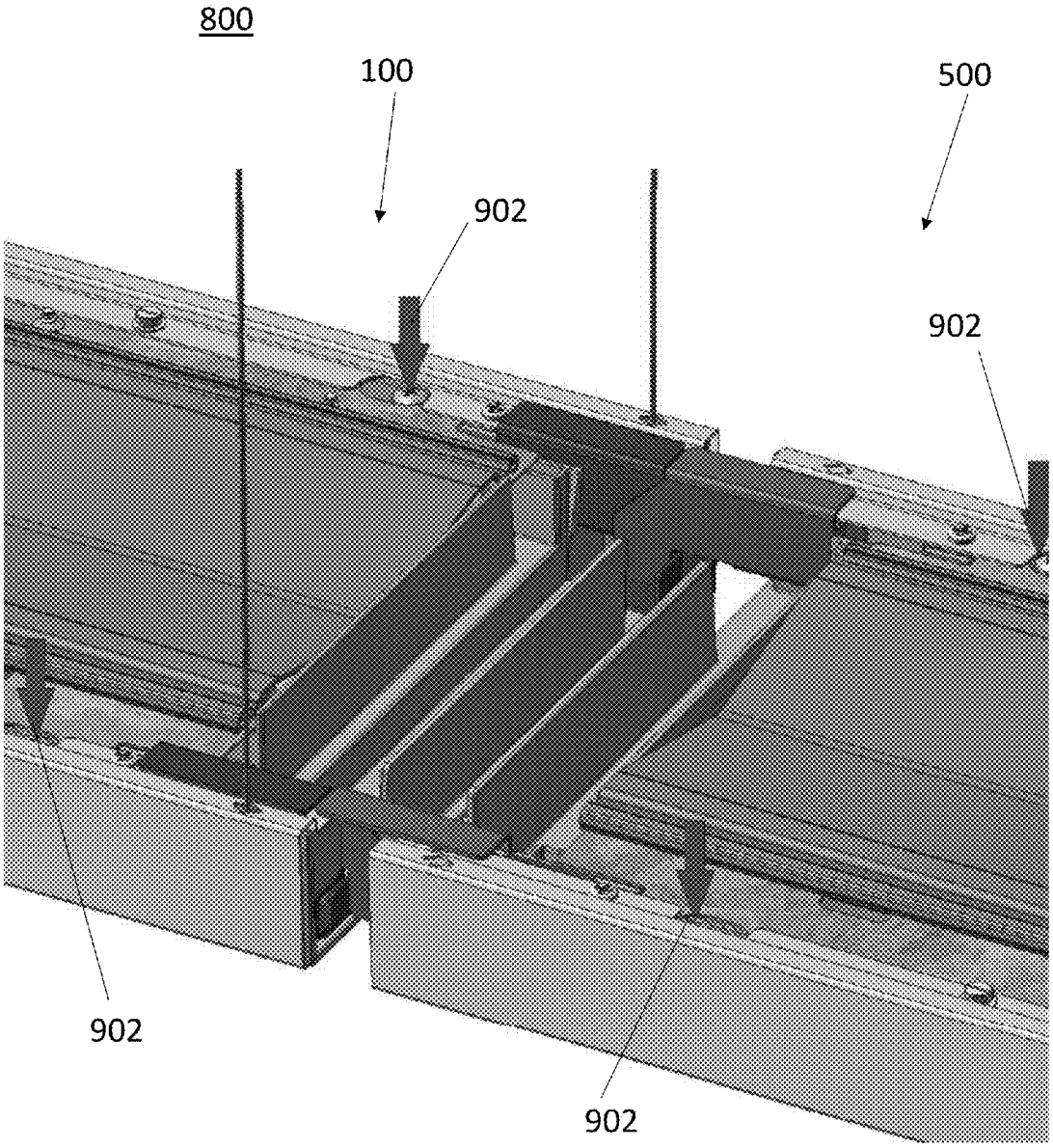

FIG. 9 illustrates another view of a fully assembled set of linear light fixtures in accordance with various aspects described herein.

Figure 10:
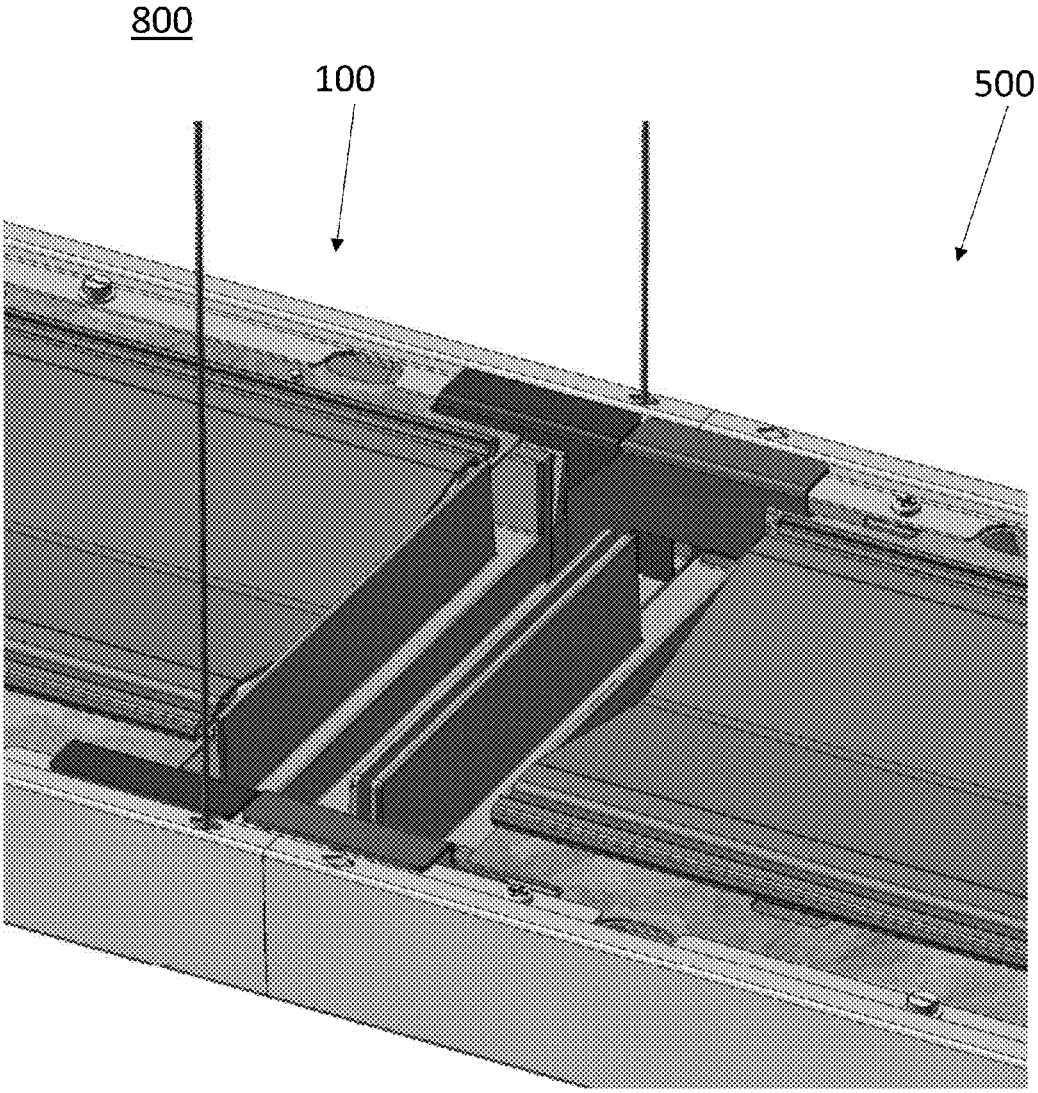

FIG. 10 illustrates another view of a fully assembled set of linear light fixtures in accordance with various aspects described herein.

Figure 11:
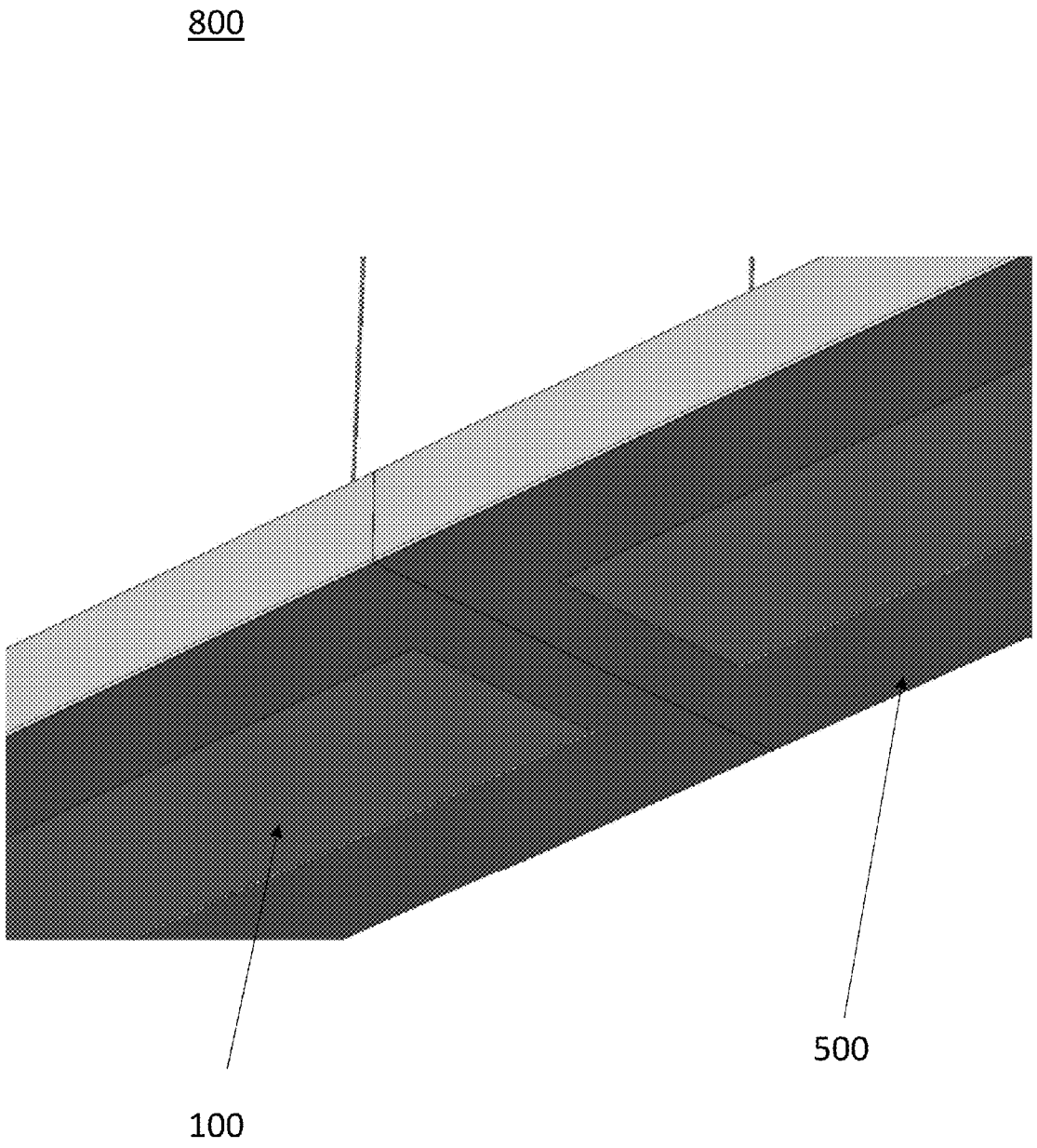

FIG. 11 illustrates another view of a fully assembled set of linear light fixtures in accordance with various aspects described herein.

Figure 12:
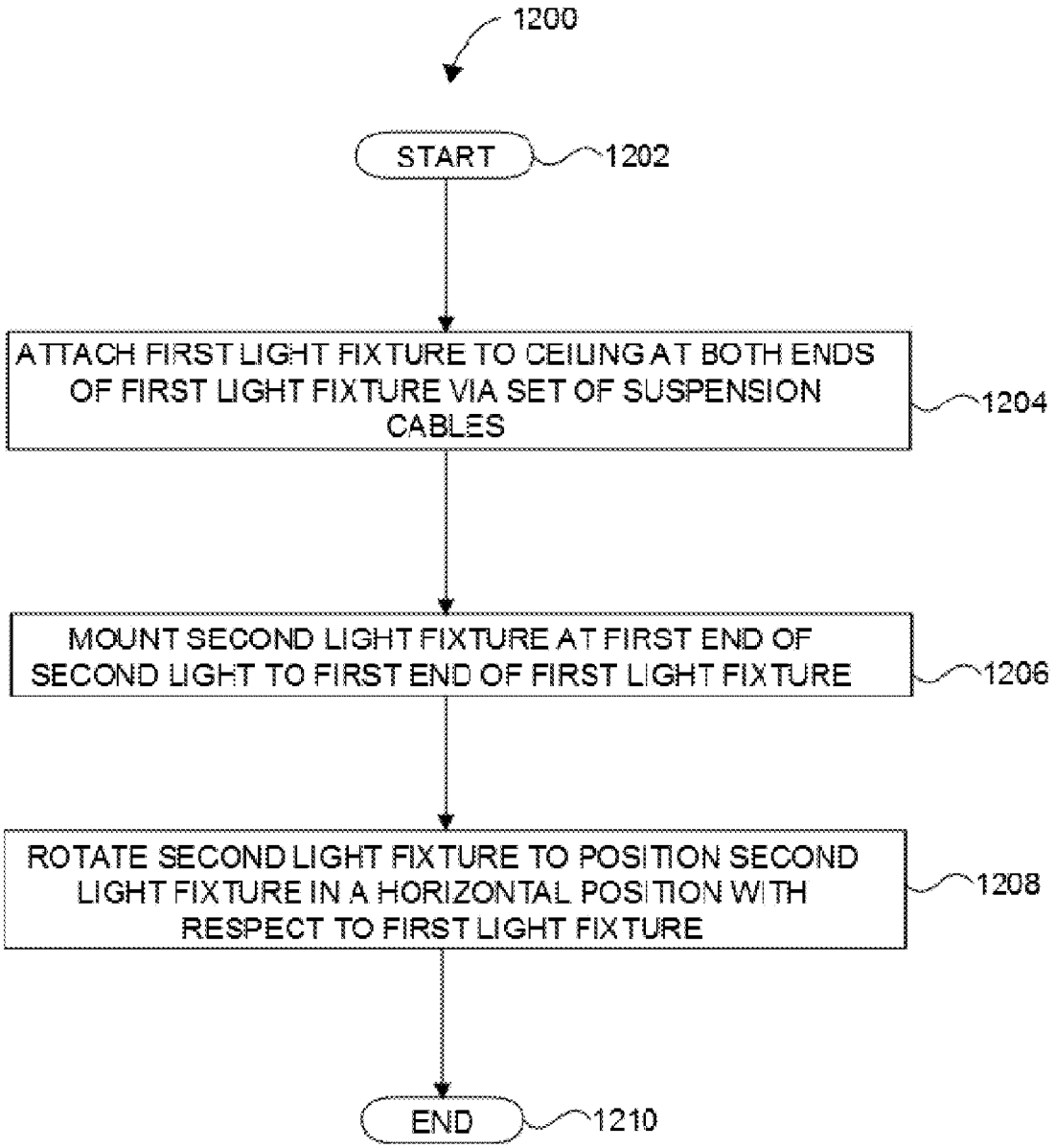

FIG. 12 illustrates a method of assembling a set of linear light fixtures in accordance with various aspects described herein.

VI. DETAILED DESCRIPTION

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

According to some embodiments, some light fixture assemblies can include a set of retractable hook receptacles disposed at one end of a first light fixture (the fixture already being suspended from a ceiling). A second fixture can also include retractable hooks so that the second fixture can temporarily be suspended to the first fixture in a vertical position.

The hooks and hook receptacles allow the second fixture to be able to rotate with respect to the first fixture. The second fixture is then brought to the horizontal position, thereby allowing the attachment of suspension (or aircraft) cables onto it.

Further, in some embodiments, an exemplary light fixture includes mechanism that allows screws to be tightened so as to pull on the hooks and hook receptacles in order to bring another fixture together with the light fixture. This operation simultaneously secures the two fixtures and hides the mechanism. Also, the screws are placed in a vertical orientation, so they are easily accessible from the top side of the fixture. Several exemplary embodiments consistent with the above-noted descriptions are described below in regards to FIGS. 1-11.

Figure 1:
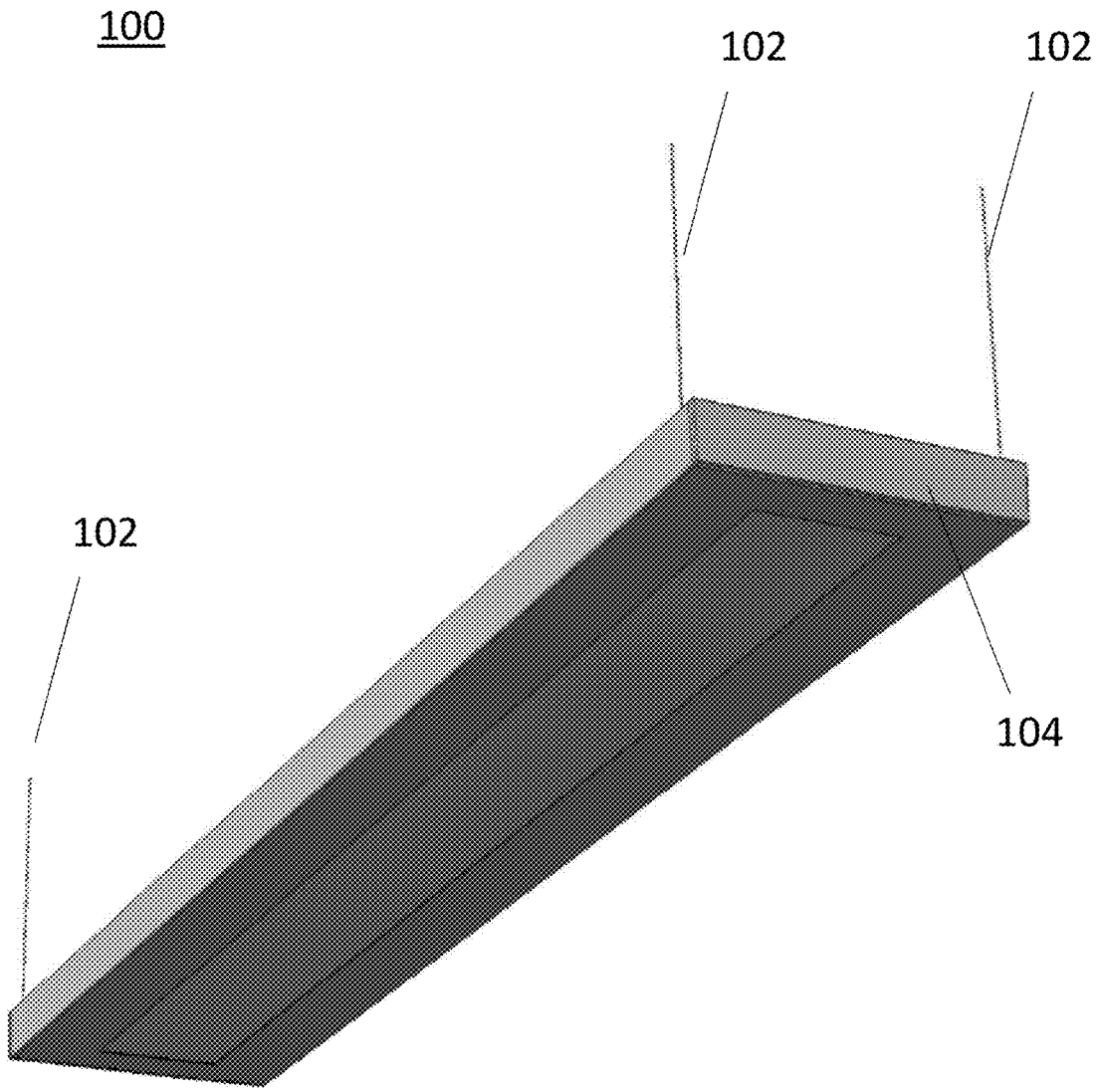
FIG. 1 illustrates a linear light fixture in accordance with various aspects described herein.

FIG. 1 illustrates a light fixture 100 that is suspended from a ceiling (not shown) via suspension (or aircraft) cables 102. The light fixture 100 includes an end portion 104, which includes a door or an end plate that can be removed when attaching the light fixture 100 to another light fixture, as shall be described in greater detail below.

Figure 2:
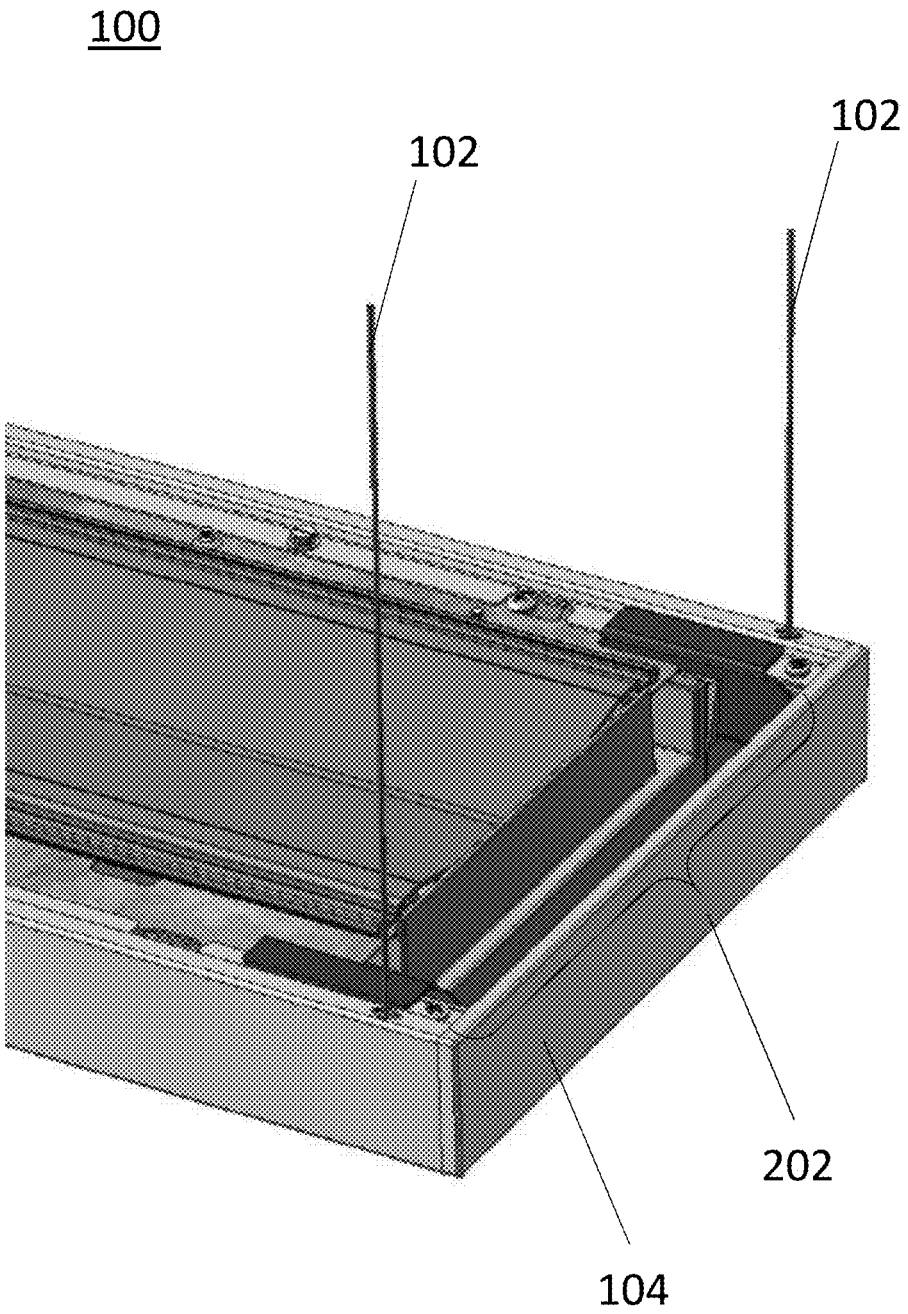
FIG. 2 illustrates an end portion of a linear light fixture in accordance with various aspects described herein.
Figure 3:
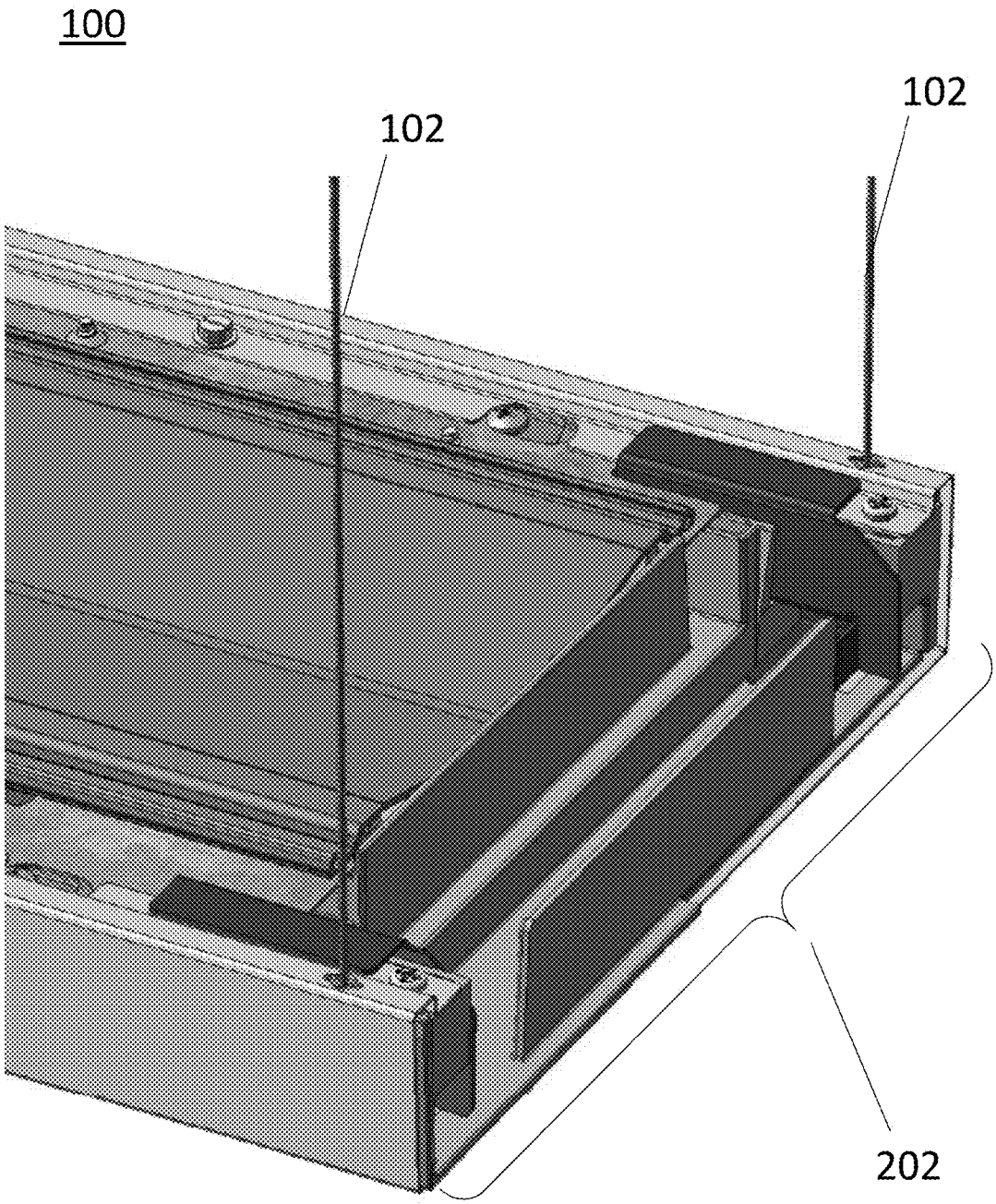
FIG. 3 illustrates another view of an end portion of a linear light fixture in accordance with various aspects described herein.

FIG. 2 illustrates the light fixture 100 from a top perspective view, showing a mechanism (i.e., a mechanical interconnect) 202 that can be used to secure the light fixture 100 on another like light fixture. As shown in FIG. 3, for getting the light fixture 100 ready for mounting in a continuous row with other like light fixtures, the end plate of the portion 104 is removed, thus exposing the mechanism 202.

The light fixture 100 includes two hooks 402 (see FIG. 4) that are part of the mechanism 202. In some embodiments, the hooks 402 can be retractable, i.e. moveable to slide inward into the frame on the rails 404 of the light fixture 100. In other embodiments, however, the hooks 402 can be prepositioned and fixed in a desired position.

Figure 4:
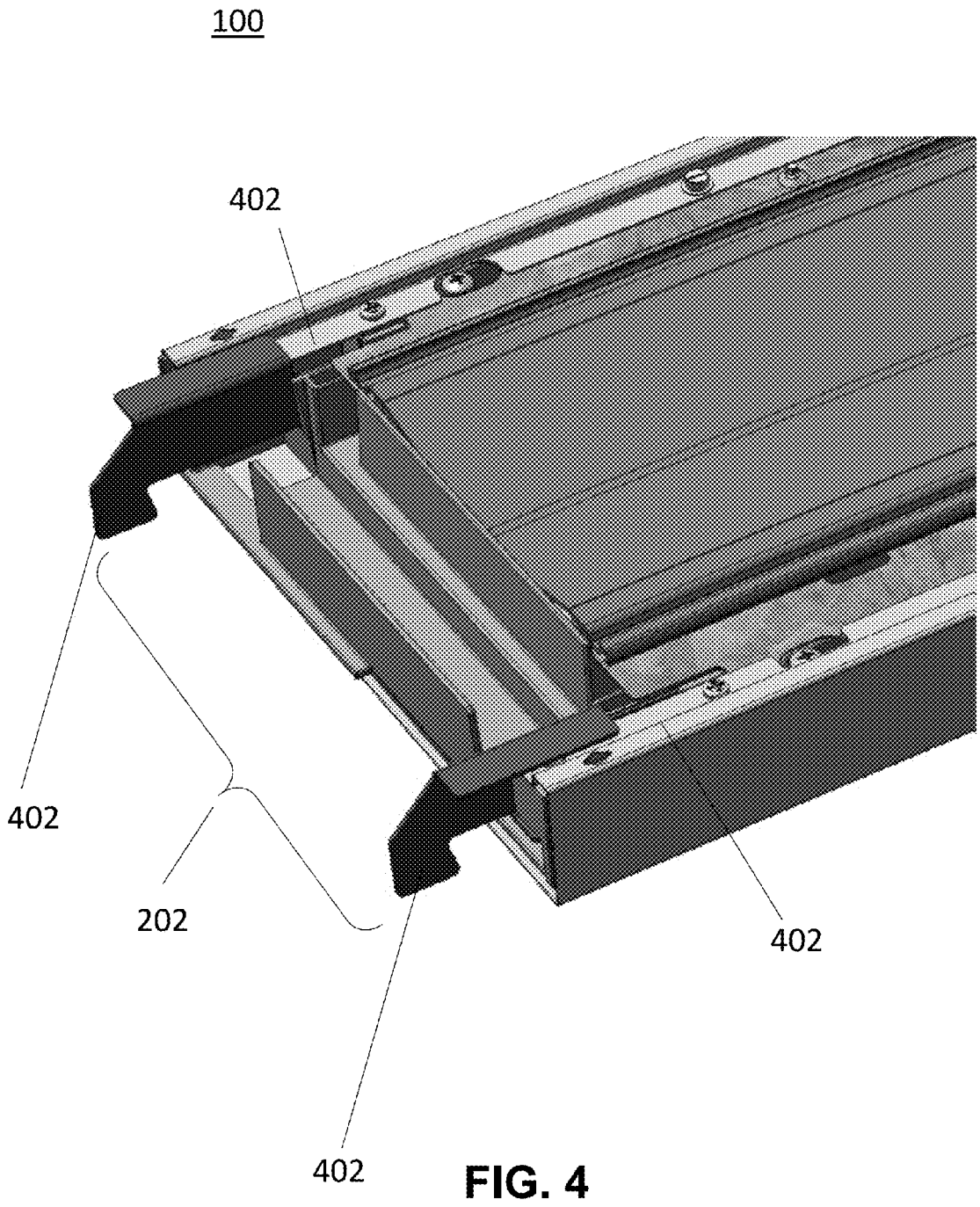
FIG. 4 illustrates a mechanism of a linear light fixture in accordance with various aspects described herein.

FIG. 5 shows a first step undertaken when assembling the light fixture 100 with another like light fixture, i.e. the light fixture 500. As shown in FIG. 4, each of the light fixtures 100 and 500 includes a mechanism 202 that includes a set of retractable hooks 402.

As shown in FIG. 6, the light fixture 500 can be placed in a vertical position with respect to the light fixture 100, and the former's set of hooks 402 can be used to latch the light fixture 500 onto the light fixture 100 via receptacles that are appropriately sized and positioned to receive the set of hooks 402, as illustrated in the light fixture assembly 700 of FIG. 7.

Once the set of hooks 402 of the light fixture 500 engage the hook receptacles of the light fixture 100, the light fixture 500 can be rotated from the vertical position to the horizontal position shown in the light fixture assembly 800 of FIG. 8, readily providing alignment between the two fixtures. The light fixture assembly 800 can be put together by a single technician, as alignment is readily provided by the mechanisms 202 of each of the light fixtures 100 and 500.

The light fixture 500 can then be pushed towards the light fixture 100 to effectively hid the mechanisms 202 of each of the light fixtures (see FIGS. 9 and 10). A set of vertically placed screws 902 can then be used to secure the two light fixtures mechanically by preventing the set of retractable hooks from each fixture to slide. Moreover, securing the two light fixtures together automatically hides the mechanisms 202 of each light fixture from view. As such, unlike typical continuous row of linear light fixtures, in the assembly 800 the joining mechanism is automatically hidden from view and alignment is ensured by the mechanism itself rather than by the subjective assessment of a technician.

FIG. 11 illustrates the assembly 800 from a bottom perspective, specifically showing that the rotative joining mechanisms 202 of each light fixture is hidden from view. Another advantage afforded by the mechanisms 202 is that at least one light fixture in the continuous row can be mounted to the ceiling using only two suspension cables as opposed to the four or more cables that are typically used.

Having set forth several structural embodiments, a method 1200 consistent with these embodiments is described with respect to FIG. 12. The method 1200 may being at block 1202. At block 1204, the method 1200 includes attaching a first light fixture to a ceiling at both ends of the first light fixture via a set of suspension cables. In other words, the method 1200 can include first fixing a first light fixture to the ceiling, and as shall be seen below, subsequently attaching additional light fixtures to form a linear assembly of light fixtures.

The method 1200 includes, at block 1206, mounting a second light fixture at a first end of the second light fixture to a second end of the first light fixture. In this step, the second light fixture is disposed vertically relative to the first light fixture. At block 1208, includes the method 1200 includes rotating the second light fixture to position the second light fixture in a horizontal position with respect to the first light fixture. The method 1200 may further include, at block 1208, extending a set of retractable hooks in both the first and second light fixtures, and subsequently sliding the two fixtures against one another and then securing the hooks together, with a set of screws, for example.

The method 1200 may include adding a third light fixture at the free end of the second light fixture, in a manner similar to that described above with respect to mounting the second light fixture to the first light fixture. Generally, the method 1200 can include adding mounting a plurality of additional light fixtures subsequently to mounting the first light fixtures on the ceiling. The method 1200 ends at block 1210.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. A light fixture, comprising:

a mechanism for attaching the light fixture to another light fixture, wherein the mechanism includes a set of retractable hooks configured to mate with an end of the other light fixture to attach the light fixture to the other light fixture;

wherein the set of retractable hooks is configured to temporarily position the light fixture in a vertical position with respect to the other light fixture, and wherein the mechanism is further configured to allow the light fixture to rotate to a horizontal position from the vertical position.

2. The light fixture of claim 1, wherein the mechanism further includes a set of screws configured to secure the set of retractable hooks in a fixed position.

3. The light fixture of claim 1, wherein when the light fixture and the other light fixture are attached to one another the mechanism is not visible.

4. The light fixture of claim 1, wherein the set of retractable hooks is configured to latch onto an end of the other light fixture when the light fixture is disposed in the vertical position.

5. The light fixture of claim 1, wherein the mechanism is further configured to allow the light fixture to slide towards the other light fixture when placed in the horizontal position.

6. The light fixture of claim 5, wherein the mechanism further includes a set of screws configured to secure the light fixture to the other light fixture after sliding the light fixture towards the other light fixture.

7. The light fixture of claim 1, wherein the light fixture and the other light fixture are each a linear suspended light fixture.

8. A light fixture assembly, comprising:

a set of suspended light fixtures including a first light fixture and a second light fixture connected via a mechanism hidden from view, wherein the mechanism includes a set of hooks configured to mate with an end of one of the first and second light fixtures;

wherein the set of hooks is configured to temporarily position one of the first and second light fixtures in a vertical position with respect to the other one of the first and second light fixtures, and wherein the mechanism is further configured to allow the one of the first and second light fixtures temporarily placed in the vertical position, to rotate to a horizontal position.

9. The light fixture assembly of claim 8, wherein the mechanism further includes a set of screws configured to secure the set of hooks in a fixed position.

10. The light fixture assembly of claim 8, wherein the set of hooks is configured to latch onto an end of one of the one of first and second light fixtures placed in the vertical position.

11. The light fixture assembly of claim 8, wherein the mechanism is further configured to allow the one of the first and second light fixtures rotated to the horizontal position to slide towards the other one of the first and second light fixtures.

12. The light fixture assembly of claim 11, wherein the mechanism further includes a set of screws configured to secure the one of the first and second light fixtures to the other one of the first and second light fixtures after sliding the one of the first and second light fixtures towards the other one of the first and second light fixtures.

13. The light fixture assembly of claim 8, wherein the first and second light fixtures are each a linear light fixture.

14. The light fixture assembly of claim 8, wherein the first and second light fixtures are suspended from a ceiling.

15. The light fixture assembly of claim 8, wherein the first and second light fixtures are suspending from a ceiling by a set of cables.

16. The light fixture assembly of claim 15, wherein one of the first and second light fixtures is suspended utilizing at most two cables.

17. A method of assembling a set of light fixtures, the method comprising:

attaching a first light fixture to a ceiling at both ends of the first light fixture via a set of suspension cables;

mounting a second light fixture at a first end of the second light fixture to a second end of the first light fixture, wherein when mounted, the second light fixture is disposed in a vertical position with respect to the first light fixture;

rotating the second light fixture to position the second light fixture in a horizontal position with respect to the first light fixture; and engaging, after the rotating, a mechanism configured to secure the second light fixture to the firsts light fixture, wherein the engaging includes extending a set of retractable hooks.

18. The method of claim 17, the mounting further comprising securing the set of retractable hooks with a set of screws.

19. The method of claim 17, further comprising, attaching a second end of the second light fixture to the ceiling, once the second light fixture is positioned in the horizontal position and secured to the first light fixture.

20. The method of claim 19, further comprising mounting a third light fixture to the second end of the second light fixture, wherein the third light fixture is disposed vertically with respect to the first and second light fixtures.

* * * * *